United States Patent [19]

Eriksen

[11] Patent Number: 4,898,517

[45] Date of Patent: Feb. 6, 1990

[54] STEAM/AIR EJECTOR FOR GENERATING A VACUUM

[76] Inventor: Olof A. Eriksen, 1 Saddle Rd., Cedar Knolls, N.J. 07927

[21] Appl. No.: 260,791

[22] Filed: Oct. 21, 1988

[51] Int. Cl.[4] ..... F04F 5/00

[52] U.S. Cl. ..... 417/151; 417/238

[58] Field of Search ..... 417/151, 163, 174, 198, 417/182, 238; 239/600

[56] References Cited

U.S. PATENT DOCUMENTS

| | | | |
|---|---|---|---|
| 1,509,090 | 9/1924 | Allyn | 417/163 |
| 2,310,265 | 2/1943 | Sweeny | 417/151 |
| 2,631,774 | 3/1953 | Plummer, Jr. | 417/151 |

FOREIGN PATENT DOCUMENTS

| | | | |
|---|---|---|---|
| 15681 | 7/1913 | Fed. Rep. of Germany | 417/163 |
| 769929 | 9/1934 | France | 417/163 |
| 933502 | 4/1948 | France | 417/151 |

*Primary Examiner*—John J. Vrablik

*Assistant Examiner*—Robert N. Blackmon

*Attorney, Agent, or Firm*—Richard T. Laughlin; Anthony Lagani, Jr.; Horst Kasper

[57] ABSTRACT

An ejector (10) is provided, which has an easily replaceable nozzle unit (22). The ejector includes a steam chest (16), a suction chamber (18), a diffuser (20) and a nozzle unit, wherein the steam chest has an outside end wall (24) having an opening with a removable cap (32) for removing the nozzle unit and for replacing the nozzle unit, or a duplicate thereof, through the opening. The steam chest has an axis and has a coaxial steam chest cavity (29) with an inlet opening (34) for steam. The suction chamber connects coaxially to the steam chest and has a coaxial suction chamber cavity with an inlet opening. The diffuser is coaxial with the steam chest and the suction chamber and has an elongate coaxial passage for exhausting the suction chamber cavity. The nozzle unit interconnects the steam chest cavity and the suction chamber cavity is coaxial therewith.

2 Claims, 3 Drawing Sheets

FIG. 4
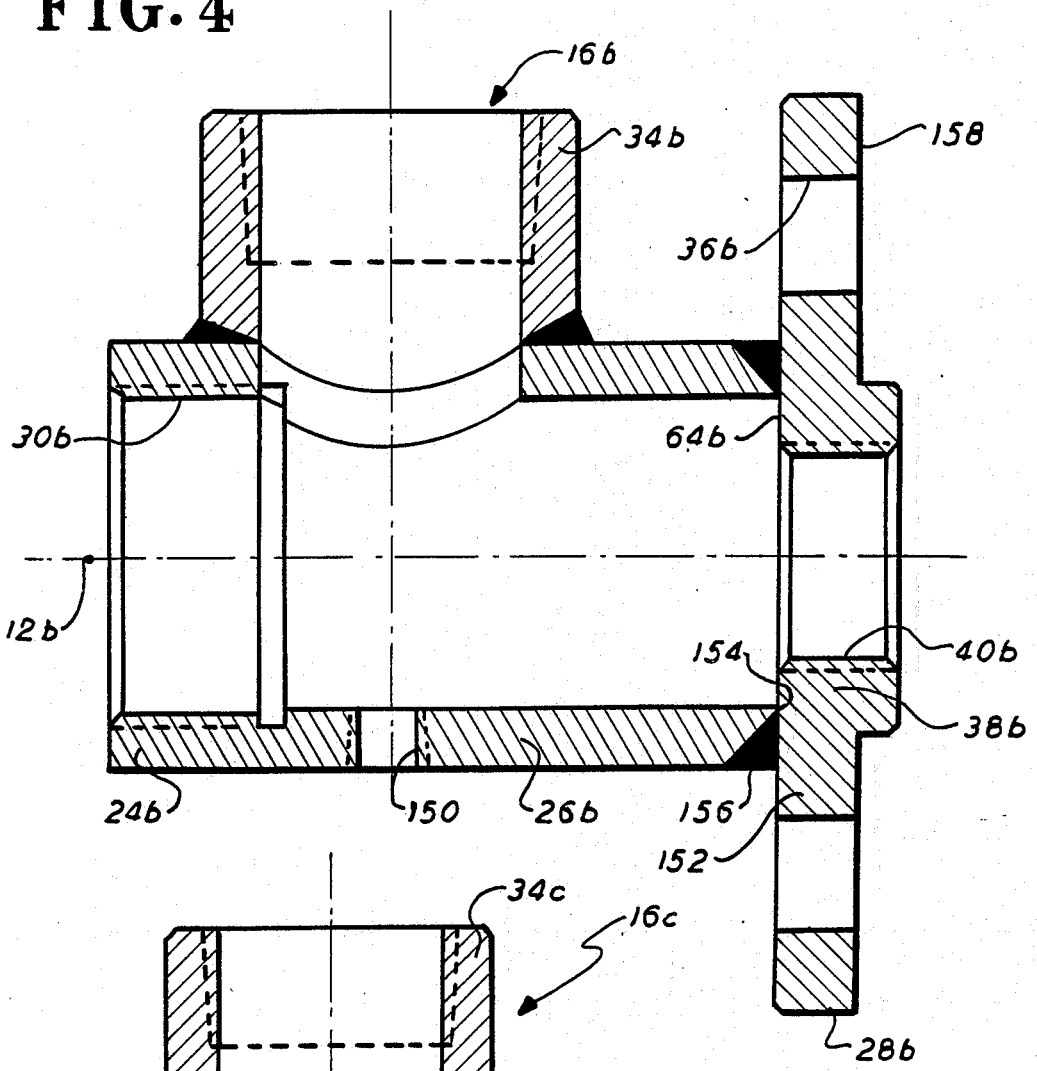
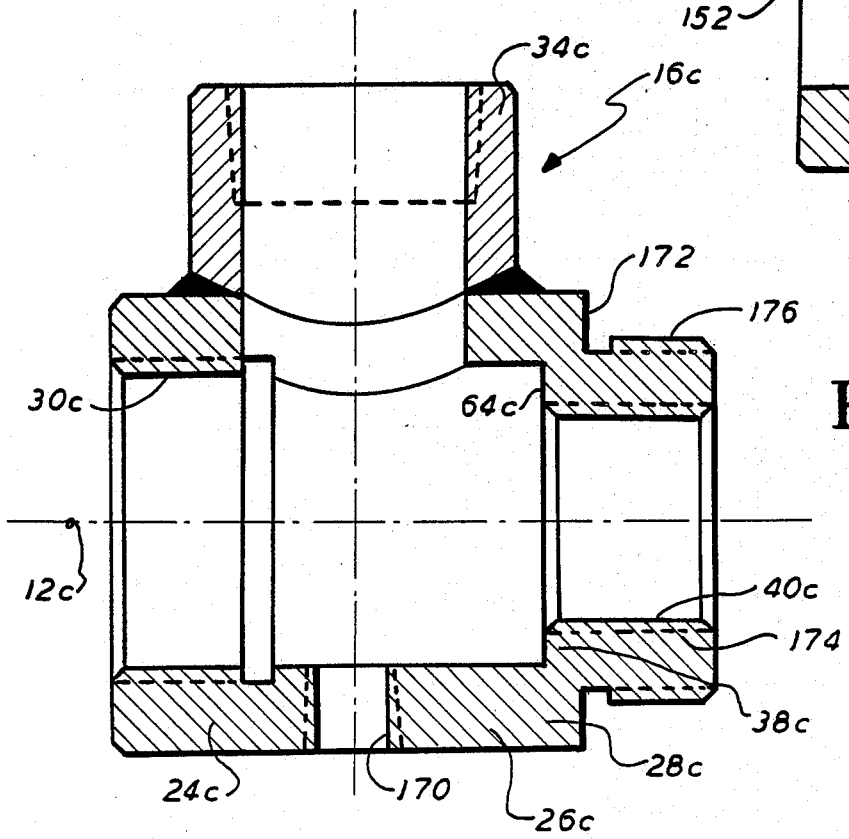
FIG. 5

STEAM/AIR EJECTOR FOR GENERATING A VACUUM

The invention generally relates to an ejector, and in particular the invention relates to a steam chest allowing for an easily replaceable nozzle subassembly.

BACKGROUND OF THE INVENTION

The prior art ejectors include a steam chest having an axis and a steam chest cavity, a suction chamber coaxial with the steam chest and having a suction chamber cavity, a diffuser coaxial with steam chest and suction chamber and having an elongate passage, a nozzle subassembly extending from the steam chest through the suction chamber cavity, and a construction joint disposed between the steam chest and suction chamber for disassembly and reassembly thereof for replacing, cleaning or repairing the nozzle subassembly.

One problem with the prior art ejector assembly is that the time to disassemble and reassemble the steam chest and the nozzle subassembly into the suction chamber is relatively long causing extensive down time of the associated processing equipment.

SUMMARY OF THE INVENTION

According to the present invention, a modified ejector is provided which is easily disassembled. This ejector includes a steam chest having an axis and having a steam chest cavity, a suction chamber coaxial with the steam chest and having a suction chamber cavity, a diffuser coaxial with the steam chest and the suction chamber and having an elongate passage, a nozzle subassembly extending through the steam chest cavity and the suction chamber cavity, said steam chest having an outside end wall and a peripheral wall and an inside end wall with the nozzle subassembly, said opening having a removable cap for removing and replacing the nozzle subassembly therethrough.

By using the end wall opening and removable cap disposed coaxially with the nozzle subassembly, the time of replacing the nozzle subassembly is minimized.

The foregoing and other objects, features and advantages will be apparent from the following description of preferred embodiments of the invention as illustrated in the accompanying drawings.

BRIEF DESCRIPTION OF THE DRAWINGS

FIGS. 4 is a section view of a third embodiment of the steam chest portion of the ejector; and FIG. 5 is a section view of a fourth embodiment of the steam chest portion of the ejector.

DESCRIPTION OF THE PREFERRED EMBODIMENTS

Figure 1:
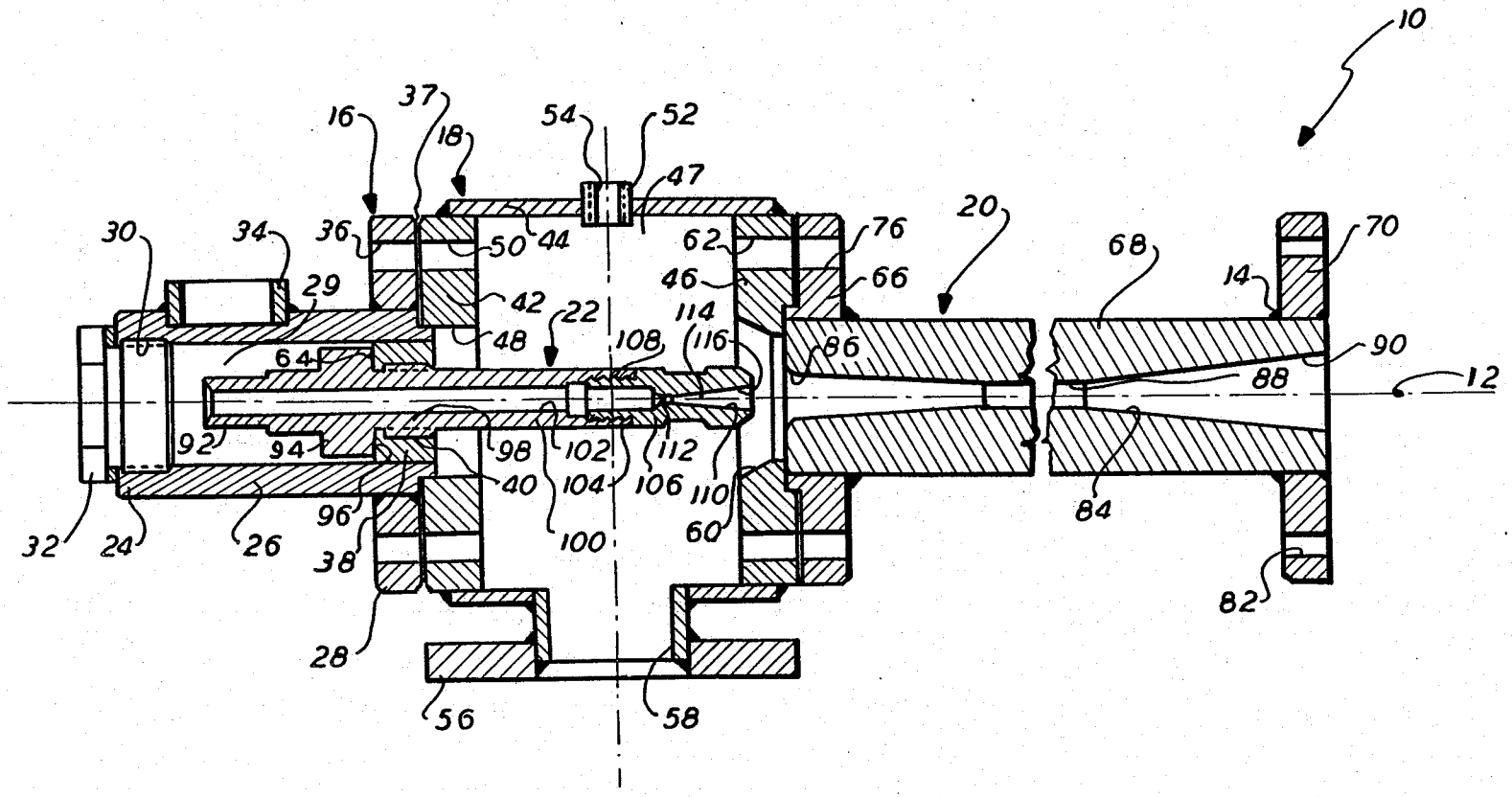
FIG. 1 is a section view of an ejector assembly according to the invention.

As shown in FIG. 1, a steam ejector 10 is provided. The ejector 10 has an elongate axis 12 and is a welded subassembly having a typical weld 14. The ejector 10 includes a steam chest 16, which has a round profile in cross section, and includes a suction chamber 18, which has a cylindrical profile in cross section. The ejector 10 also includes a diffuser 20, which has a cylindrical profile in cross section, and includes a nozzle subassembly 22, which also has a cylindrical profile in cross section and which is disposed inside the steam chest 16 and suction chamber 18, and which is supported by the steam chest 16.

The steam chest 16 has a left outside end wall 24, a peripheral wall 26 and a right inside end wall 28 forming a cavity 29. The left end wall 24 has an internally threaded hole 30 with an externally threaded cap or plug 32.

The peripheral wall 26 has a threaded pipe connection 34 for use as a fluid inlet or an air inlet or a steam inlet. Right end wall 28 has a plurality of connector holes 36 for bolts (not shown) for forming an assembly joint 37. The right end wall 28 has an inner wall portion 38, which has an internally threaded hole 40, that is coaxial with nozzle subassembly 22.

The suction chamber 18 has a left end wall 42, a peripheral wall 44, and a right end wall 46 forming a cavity 47. Walls 42, 44, 46 have a cylindrical profile in cross section.

The left end wall 42 has an inner hole 48, which is coaxial with hole 40, and with nozzle subassembly 22. Left end wall 42 has a plurality of connector holes 50 which are aligned with respective holes 36.

The peripheral wall 44 has a pipe portion 52, which has an internally threaded hole 54 for a conventional vacuum gage (not shown). Peripheral wall 44 has a flange connection 56, which has an inlet opening 58 for connection to a conventional condenser (not shown).

Right end wall 46 has an inner hole 60, which has an inner diameter that decreases in size from left to right. Hole 60 is coaxial with hole 48. The right end wall 46 also has a plurality of connector holes 62 for bolts (not shown).

The right end wall 28 of the steam chest 16 also has a bearing surface or machined surface 64 on its axially inner side. Surface 64 is a stop surface for threading nozzle assembly 22 into place, as explained hereafter, after inserting nozzle assembly 22 through hole 30.

Diffuser 20 has a left end wall 66, a peripheral wall 68, and a right end wall 70. The left end wall 66 has respectively aligned with holes 62. Peripheral wall 68 is connected to right end wall 70 which has a plurality of connector holes 82. Diffuser 20 has an elongate passage 84, which has a selective elongate inner profile, and which has an inlet portion 86 and a necked down portion 88 and a discharge portion 90.

The nozzle subassembly 22 has a left end portion 92 of hexagonal profile in cross section, and an enlarged portion 94, which has a bearing surface 96 that engages bearing surface 64. The nozzle subassembly 22 has a threaded portion 98, which is threaded into threaded hole 40, and has a right end portion 100. The nozzle subassembly 22 further has an elongate passage 102.

Right end portion 100 has an internally threaded portion 104, which receives a nozzle insert 106. The insert 106 has an externally threaded portion 108, which is received in portion 104. The insert 106 has a passage 110, which has an inlet portion 112, a necked down portion 114 and an outlet portion 116.

With the construction of the ejector 10, end cap 32 can be removed in order to remove nozzle subassembly 22 through end hole 30. Thus, the time to replace nozzle subassembly 22 is minimized. The primary benefit of ejector 10 is that it can be easily taken apart to replace the nozzle assembly 22, which is the part that has the most wear.

Following are advantages of the ejector 10:

Only the step of checking or removing nozzle assembly 22 is required. Many additional steps to check the prior art ejector are avoided.

First, disconnect of steam line is avoided.

Second, removal of steam pressure gage is avoided.

Third, removal of steam chest bolts is avoided.

Fourth, prying loose of steam chest is avoided.

Fifth, unscrewing extensions and removing spacers are avoided.

Sixth, after checking the nozzle subassembly, the reinstalling of a gasket between the steam chest and suction chamber is avoided.

Seventh, reinstalling the steam chest bolts is avoided.

Eighth, reinstalling the steam pressure gage is avoided.

Ninth, reconnecting the steam line is avoided.

Other advantages of generator 10 are indicated below:

Only the detail steps of unscrewing the cap 32 and nozzle subassembly 22 using wrenches, and later screwing back the nozzle subassembly 22 and cap 32 are required.

Figure 2:
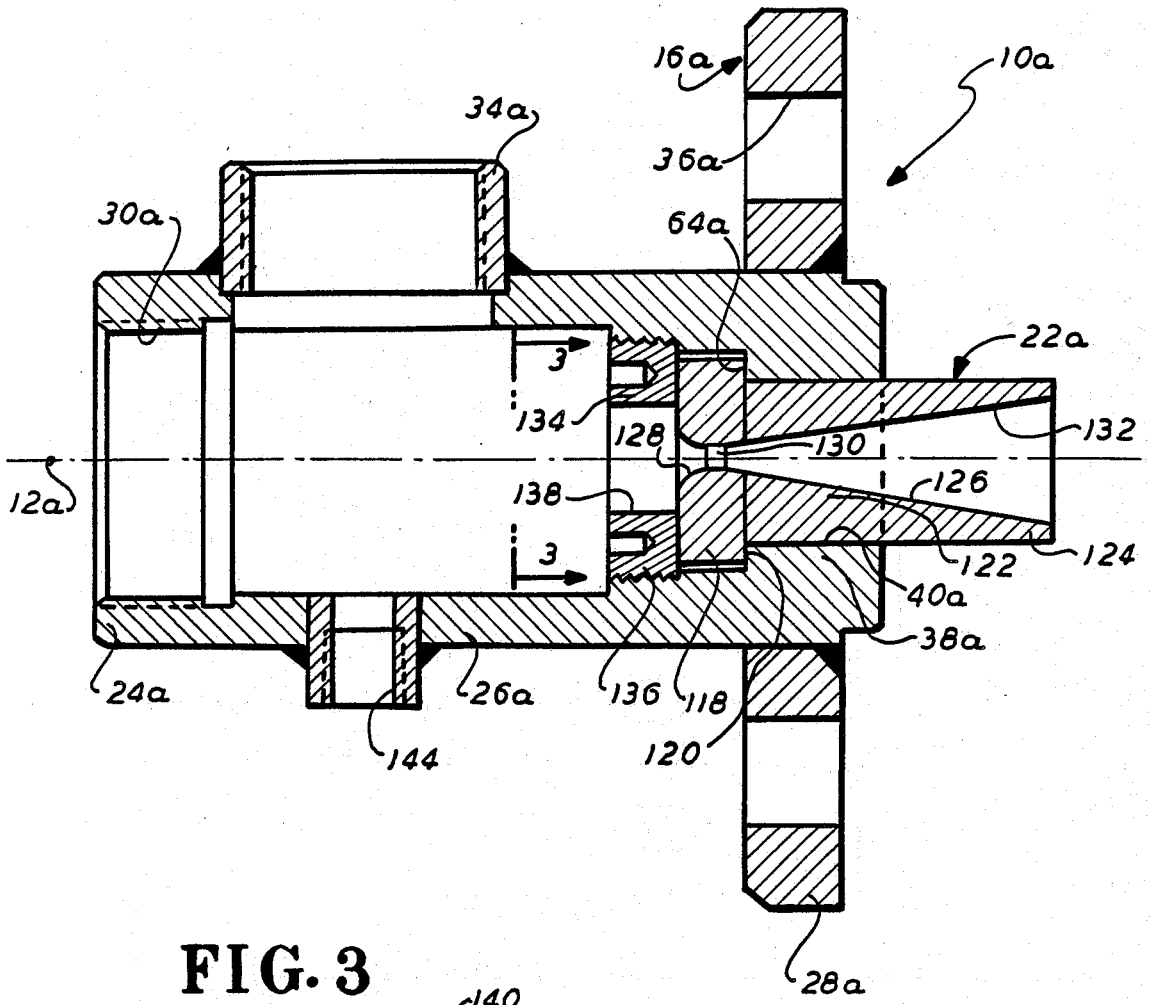
FIG. 2 is a section view of a second embodiment of the ejector with a steam chest portion.

FIG. 2 shows a second embodiment or ejector **10*a*. Parts of ejector 10*a* in FIG. 2, which are the same as parts of the ejector 10 in FIG. 1, have the same numerals, but with a subscript "a" added thereto. FIG. 2 corresponds to a portion only of FIG. 1**.

The ejector **10*a* which has an axis 12*a*, includes a steam chest 16*a* and a nozzle subassembly 22, supported therefrom. The steam chest 16*a* has a left wall 24*a*, a peripheral wall 26*a* and a right wall 28*a*. Left wall 24*a* has an internally threaded end hole 30*a*. The peripheral wall 26*a* has an internally threaded gage hole 144 and has an internally threaded pipe connection 34*a*. Right wall 28*a* has a plurality of connector holes 36*a* and an inner wall portion 38*a*, which has a threaded inner hole 40*a***.

Nozzle subassembly **22*a* has an enlarged portion 118 with a bearing surface 120 which engages a surface 64*a* on wall 38*a*. Nozzle subassembly 22*a* has an externally threaded portion 122 and a right end portion 124. The nozzle subassembly 22*a* also has a passage 126. The passage 126 has an inlet portion 128, a necked down portion 130, and an outlet portion 132**.

Figure 3:
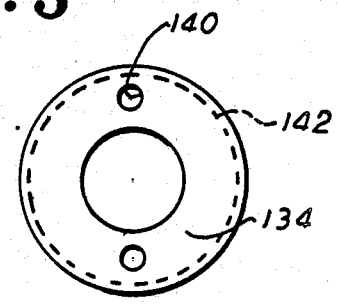
FIG. 3 is a section view as taken along the line 3—3 of FIG. 2.

As shown in FIG. 3, assembly **22*a* has a lock nut 134. Peripheral wall 26*a* has an internally threaded portion 136: and look nut 134 has an externally threaded portion 142, received by portion 136. The lock nut 134 has a passage portion 138 which is coaxial with passage 126. Lock nut 134 also has two tool receiving holes 140**, which can receive a tool wrench with a dual prong head (not shown).

The nozzle assembly **22*a* is better able to resist loosening thereof due to vibration, because lock nut 134 provides a locking force thereon. The nozzle assembly 22*a*** is less complicated to manufacture, as it is one piece; and it is more rigid, as it has a smaller length to diameter ratio.

FIG. 4 shows a third embodiment of a steam chest **16*b*, which has a circular profile in cross section and which is a portion of an ejector. Parts of steam chest 16*b* in FIG. 4, which are the same as parts of steam chest 16 in FIG. 1, have the same numerals, but with a subscript "b" added thereto. FIG. 4 corresponds to a steam chest portion only of FIG. 1**.

Steam chest **16*b*, which has an axis 12*b*, includes a left outside end wall 25*b*, a peripheral wall 26*b* and a right inside end wall 28*b*. Left wall 24*b* has an internally threaded end hole 30*b*. Peripheral wall 26*b* has an internally threaded gage hole 130, and has an internally threaded pipe connection 34*b*. Right wall 28*b* has a plurality of connector holes 36*b*, and has an inner wall portion 38*b*, which has a threaded inner hole 40*b*, inner wall portion 38*b* has an axially inner bearing surface 64*b*** for bearing against a nozzle assembly.

Right wall **28*b* has an axially inner machined surface portion 152. Peripheral wall 26*b* has an axially outer machined surface 154, which faces surface 152. Surfaces 152 and 154 have an annular butt weld 156, which is disposed therebetween. Right wall 28*b* has an axially outer surface 158** for forming part of a construction joint with a left wall of an ejector suction chamber.

Right wall **28*b*** is a circular, one piece, machined plate for ease of manufacture thereof.

FIG. 5 shows a fourth embodiment of a steam chest **16*c* which has a circular profile in cross section. Parts of steam chest 16*c*, which are the same as parts of steam chest 16 in FIG. 1, have the same numerals, but with a subscript "c" added thereto. FIG. 5 corresponds to a steam chest portion only of FIG. 1**.

Steam chest **16*c*, which has an axis 12*c*, includes a left outside end wall 24*c*, a peripheral wall 26*c*, and a right inside end wall 28*c*. Left wall 24*c* has an internally threaded end hole 30*c*. Peripheral wall 26*c* has an internally threaded gage hole 170, and has an internally threaded pipe connection 34*c*. Right wall 28*c* has an inner wall portion 38*c*, which has a threaded inner hole 40*c*. Inner wall portion 38*c* has an axially inner bearing surface 64*c*** for bearing against a nozzle assembly.

Right wall **28*c* has an axially outer surface 172 for forming part of a construction joint with a left wall of an ejector suction chamber. Right wall 28*c* has a projecting portion 174 which has a radially outer, externally threaded circular surface 176**, for threading into a radially inner internally threaded hole (not shown) in a left wall of an ejector suction chamber.

Right wall **28*c*** is a threaded unit for ease of disassembly from and reassembly to an ejector suction chamber.

Although the construction as shown of each embodiment has many parts welded together it should be apparent that any method of assembly is suitable and the sections can be constructed of single pieces rather than the sub sections shown. Further, although the apparatus has been disclosed as used with steam it can also be utilized with air or any similar fluid or gas.

While the invention has been described in its preferred embodiments, it is to be understood that the words which have been used are words of description rather than limitation and that changes may be made within the purview of the appended claims without departing from the true scope and spirit of the invention in its broader aspects.

What is claimed is:

1. An ejector comprising:

a steam chest having an axis and having a coaxial steam chest cavity with an inlet opening;

a suction chamber connecting coaxially to the steam chest and having a coaxial suction chamber cavity with an inlet opening;

a diffuser coaxial with the steam chest and the suction chamber and having an elongate coaxial passage for exhausting the suction chamber cavity;

a nozzle unit extending through the steam chest cavity and the suction chamber cavity coaxially therewith;

said steam chest having an outside end wall and a peripheral wall and an inside end wall enclosing the steam chest cavity;

said outside end wall having an opening disposed coaxially with the nozzle unit; and said opening having a removable cap for removing the nozzle unit and for replacing the nozzle unit or a duplicate thereof through the opening, wherein the nozzle unit has an enlarged portion having a bearing surface for engaging a bearing surface in the steam chest, and wherein the nozzle unit has an externally threaded portion for receival in an internally threaded hole in the steam chest, and wherein the nozzle unit has an elongate passage interconnecting the steam chest cavity with the suction chest cavity with the suction chamber cavity, and wherein the nozzle unit has an end portion with an opening, and wherein the nozzle unit has a nozzle insert received in the end portion opening, said nozzle insert having a passage portion, said passage portion having an inlet portion and a necked down portion and an outlet portion, and wherein said steam chest inside wall and an adjacent end wall of the suction chamber have plurality of matching holes of the same angular spacing and overall diameter for a plurality of bolts and wherein said diffuser and said suction chamber have bare adjacent respective wall portions having plurality of matching holes of the same angular spacing and overall diameter for a plurality of bolts for facilitating joining of said steam chest inlet opening and suction chamber inlet opening to outside piping connections.

2. The ejector of claim 1, including a lock nut for locking in place said nozzle unit, said lock nut having a passage portion for interconnecting the suction chamber cavity with the nozzle unit passage.

* * * * *